US011612248B2

(12) United States Patent
Leffring et al.

(10) Patent No.: US 11,612,248 B2
(45) Date of Patent: Mar. 28, 2023

(54) FOAM SEAT WITH REMOVABLE NESTING INSERT

(71) Applicant: FOMCORE, LLC, Muskegon, MI (US)

(72) Inventors: Jeremy Dustin Leffring, Muskegon, MI (US); Jeffrey Zack, Muskegon, MI (US)

(73) Assignee: FOMCORE, LLC, Muskegon, MI (US)

( * ) Notice: Subject to any disclaimer, the term of this patent is extended or adjusted under 35 U.S.C. 154(b) by 0 days.

(21) Appl. No.: 17/344,901

(22) Filed: Jun. 10, 2021

(65) Prior Publication Data

US 2021/0386205 A1 Dec. 16, 2021

Related U.S. Application Data

(60) Provisional application No. 63/037,846, filed on Jun. 11, 2020.

(51) Int. Cl.
*A47C 13/00* (2006.01)
*A47C 7/62* (2006.01)
(Continued)

(52) U.S. Cl.
CPC ..... *A47C 7/18* (2013.01); *A47C 7/021* (2013.01); *A47C 7/62* (2013.01); *A47C 7/622* (2018.08);
(Continued)

(58) Field of Classification Search
CPC ..... A47C 7/18; A47C 11/00; A47C 16/00; A47C 7/021; A47C 13/00; A47C 13/005; A47C 7/622
USPC ..... 297/1, 3, 105, 118, 440.1, 440.15, 297/440.22, 452.48, 440.14, 188.01; 5/655.9
See application file for complete search history.

(56) References Cited

U.S. PATENT DOCUMENTS 2,593,319 A * 4/1952 Levitin ..... A47C 13/00 5/652
D167,514 S * 8/1952 Hicks ..... D6/368
(Continued)

FOREIGN PATENT DOCUMENTS

GB 2520264 A * 5/2015 ..... A47C 27/085
GB 2580932 A * 8/2020 ..... A47C 7/62
WO WO-9619133 A1 * 6/1996 ..... A47C 1/16

*Primary Examiner* — Rodney B White
(74) *Attorney, Agent, or Firm* — Loomis, Ewert, Parsley, Davis & Gotting, PC; Mikhail Murshak

(57) ABSTRACT

A foam-based seat and an enclosure for a foam-based seat is provided. The foam-based seat includes a base, main body, a cutout opening formed in the main body, fitted fabric configured to encase the main body, and a removable nesting insert configured to friction fit within the cutout opening. The removable nesting insert can be inserted into the cutout opening, or removed, to provide a myriad of seating arrangements. The foam-based seat may constitute a variety of geometries, including one embodiment that is square with a square removable nesting insert, and another embodiment that is round with an expanded base and a circular nesting insert. The enclosure for a foam-based seat includes a rigid frame with two ends, an internal opening configured to circumscribe a foam-based seat, and a shelving unit that extends from the two ends of the rigid frame.

19 Claims, 15 Drawing Sheets

(51) Int. Cl.
*A47C 7/18* (2006.01)
*A47C 7/02* (2006.01)
*A47C 11/00* (2006.01)

(52) U.S. Cl.
CPC ..... *A47C 11/00* (2013.01); *A47C 13/00* (2013.01); *A47C 13/005* (2013.01)

(56) References Cited

U.S. PATENT DOCUMENTS 2,634,430 A * 4/1953 Rogers ..... A47C 17/2076 297/105 X
2,672,921 A * 3/1954 Herrick ..... A47B 21/02 297/118
2,691,409 A * 10/1954 Duke ..... A47C 17/2076 297/105 X
2,692,639 A * 10/1954 Genovese ..... A47C 13/00 297/105 X
2,693,846 A * 11/1954 Luttio ..... A47C 13/00 297/188.1
2,705,994 A * 4/1955 Stattler ..... A47C 7/407 297/105 X
2,896,695 A * 7/1959 Ashworth ..... A47C 13/00
2,966,205 A * 12/1960 Blaschko ..... A47C 13/00 297/111
D212,534 S * 10/1968 Borenstein ..... D6/349
3,606,461 A * 9/1971 Moriyam ..... A47C 13/00 297/118 X
3,655,242 A * 4/1972 Ghyczy ..... A47C 3/16 297/452.48 X
3,672,720 A * 6/1972 Wilson ..... A47C 17/045 297/105 X
3,736,023 A * 5/1973 Lyons ..... A47C 17/045 297/118
3,902,759 A * 9/1975 Monteforte ..... A47C 17/045 5/12.1
3,987,507 A * 10/1976 Hall ..... A61G 5/1091 5/653
4,139,187 A * 2/1979 Hanusa ..... A47C 7/18 267/153
4,518,203 A * 5/1985 White ..... A47C 17/045 297/109
4,530,451 A * 7/1985 Hamilton ..... A47C 4/52 297/1 X
4,635,306 A * 1/1987 Willey ..... A47C 16/005 D6/601
5,282,286 A * 2/1994 MacLeish ..... A61G 5/1045 5/655.3
5,423,597 A * 6/1995 Rogers ..... A47D 11/00 5/2.1
5,681,090 A * 10/1997 St. Thomas ..... A47C 5/12 297/452.17
6,241,320 B1 * 6/2001 Chew ..... A47C 7/021 297/452.41
6,270,155 B1 * 8/2001 Rashid ..... A47C 13/00 297/118
6,454,358 B1 * 9/2002 Benincasa ..... A47C 13/005 297/440.14
6,739,670 B2 * 5/2004 Johnson ..... A47B 83/02 297/135
6,823,545 B1 * 11/2004 Davis ..... A47C 16/02 5/652
7,131,699 B2 * 11/2006 Mulmed ..... A47C 11/00 297/440.14
7,730,566 B2 * 6/2010 Flick ..... A47C 7/021 5/655.5
8,783,778 B2 * 7/2014 Nelson ..... A47C 13/005 297/440.14 X
8,973,191 B1 * 3/2015 Kvitek ..... A47G 9/10 5/640
9,629,487 B1 * 4/2017 Kvitek ..... A47G 9/10
10,098,468 B2 * 10/2018 Olsen ..... A47C 7/70
11,375,821 B1 * 7/2022 Purvis ..... A47C 15/004
2002/0108179 A1 * 8/2002 Kiser ..... A47C 27/085 5/655.5
2007/0085406 A1 * 4/2007 White ..... A47C 4/028 297/440.1
2008/0115286 A1 * 5/2008 Flick ..... A47C 27/085 5/655.5
2010/0199437 A1 * 8/2010 Flick ..... A61G 7/05738 5/655.5
2011/0298340 A1 * 12/2011 Nelson ..... A47C 3/029 312/107
2012/0304389 A1 * 12/2012 Ranck ..... A47C 13/00 5/655.9 X
2016/0174715 A1 * 6/2016 Nelson ..... A47C 4/028 297/440.14
2017/0035216 A1 * 2/2017 MacKenzie ..... A47C 31/105
2018/0020837 A1 * 1/2018 Cheng ..... A47C 7/18 297/452.42
2019/0045933 A1 * 2/2019 Edalati ..... A47C 7/14
2022/0079347 A1 * 3/2022 Nelson ..... A47C 7/028

* cited by examiner

FOAM SEAT WITH REMOVABLE NESTING INSERT

CROSS-REFERENCE TO RELATED APPLICATION

This application claims the benefit of U.S. Provisional Patent Application No. 63/037,846 filed Jun. 11, 2020, hereby incorporated by reference.

TECHNICAL FIELD

The present disclosure relates generally to foam-based furniture.

DESCRIPTION OF RELATED ART

Foam-based furniture is known in the art. Such furniture typically includes foam mattresses, chairs, or couches with or without rigid non-foam bases, legs, or baseboards. Traditional wood or metal furniture is also known in the art. Such furniture utilizes a rigid wood, plastic, or metal frame, and often incorporates a body of these same materials. Generally, seating furniture includes a sitting platform and distinct legs or rigid base upon which the sitting platform rests. Seats will often also include a rigid backrest.

SUMMARY

The present disclosure provides for a foam-based seat with a removable nesting insert. The foam-based seat is made from a foam material covered by a fitted fabric resulting in a durable and comfortable material while also remaining lightweight. In one embodiment, the seat includes a main body geometry defining a cutout opening with a removable nesting insert that has the same geometry as the cutout opening. The removable nesting insert is configured to friction fit within the cutout opening to provide for a removable wall and a portable floor seat. An inner surface of the cutout opening matches the outer perimeter of the removable nesting insert. The removable nesting insert can be removed from the cutout opening, creating an open orientation. The removable nesting insert also serves as a standalone seating device when placed horizontally on a floor. The cutout opening is large enough for a child or adult to sit comfortably within. This divided orientation allows two users to sit with their backs to the removable nesting insert. This open orientation allows a user to lay down across or nestle within the cutout opening. The seat can be orientated so that the seating furniture unit is standing vertically or horizontally. In an example the geometry of the seating furniture unit is square or circular.

The present disclosure further provides for a foam-based seat that defines a round shape defining a circular cutout in a middle portion forming a cutout opening. In this example, the round foam-based seat further defines a base for standing vertical. A removable nesting insert friction fits within the cutout opening to provide for a removable wall and can provide for sound dampening. The removable nesting insert can serve as a standalone seating device when placed horizontally on a floor. The cutout opening is sized and shaped to allow for a user, such as a child or adult, to sit comfortably within it when the foam-based seat is in a vertical configuration and the removable nesting insert is absent. The removable nesting insert can be removed from the cutout opening, requiring very little force for removal, creating an open configuration. This open orientation allows a user to access the cutout opening in a variety of ways including sitting or lying down along a circumference of the opening shape.

For purposes of summarizing the disclosure, certain aspects, advantages, and novel features of the disclosure have been described herein. It is to be understood that not necessarily all such advantages may be achieved in accordance with any one particular embodiment of the disclosure. Thus, the disclosure may be embodied or carried out in a manner that achieves or optimizes one advantage or group of advantages as taught herein without necessarily achieving other advantages as may be taught or suggested herein. The features of the disclosure which are believed to be novel are particularly pointed out and distinctly claimed in the concluding portion of the specification. These and other features, aspects, and advantages of the present disclosure will become better understood with reference to the following drawings and detailed description.

BRIEF DESCRIPTION OF THE DRAWINGS

The figures which accompany the written portion of this specification illustrate systems of use for the present disclosure constructed and operative according to the teachings of the present disclosure.

The various embodiments of the present disclosure will hereinafter be described in conjunction with the appended drawings, wherein like designations denote like elements.

DETAILED DESCRIPTION

Figure 1:
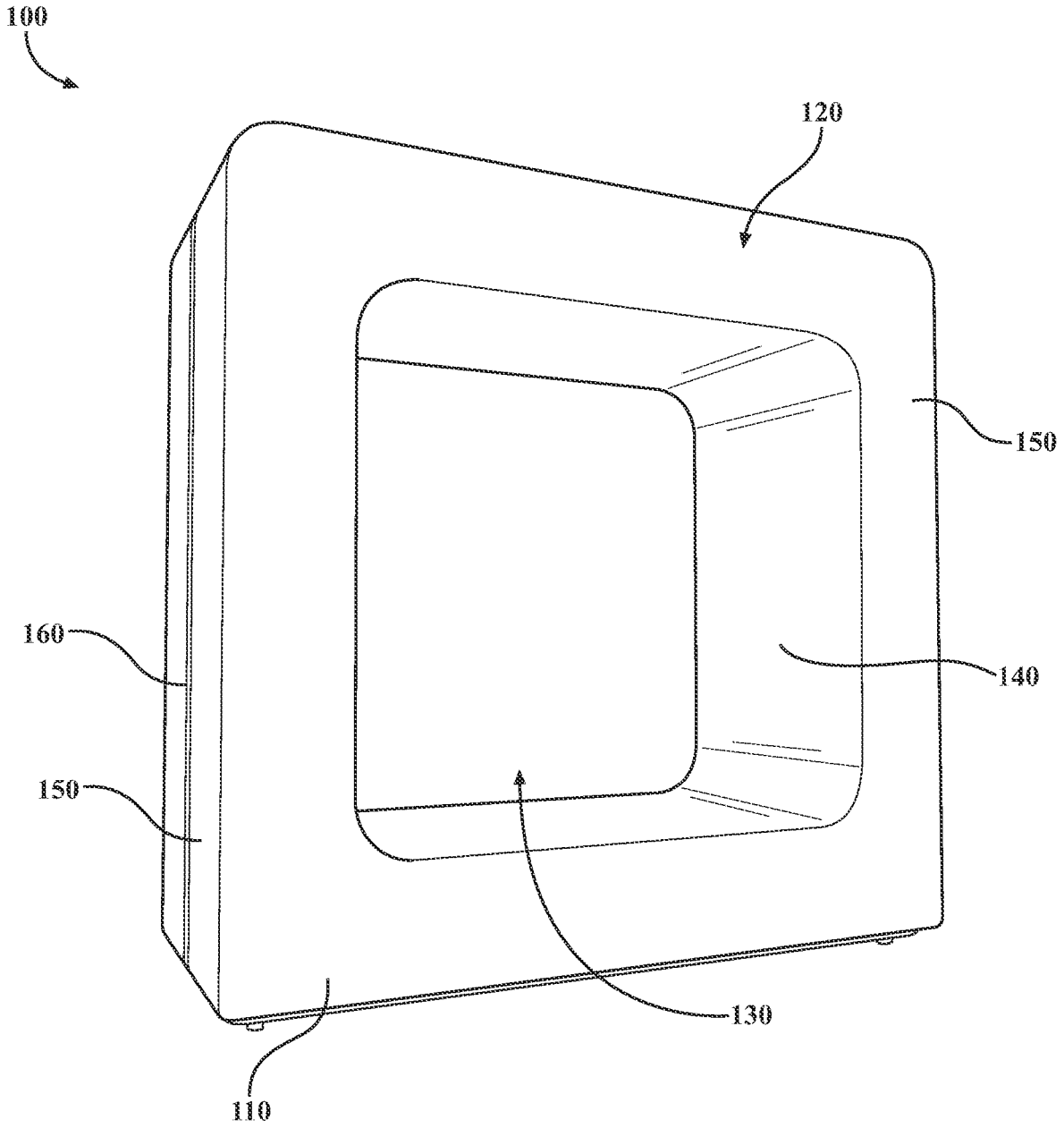
FIG. 1 illustrates a perspective view of a foam-based square seat defining a center cutout forming a cutout opening.
Figure 2:
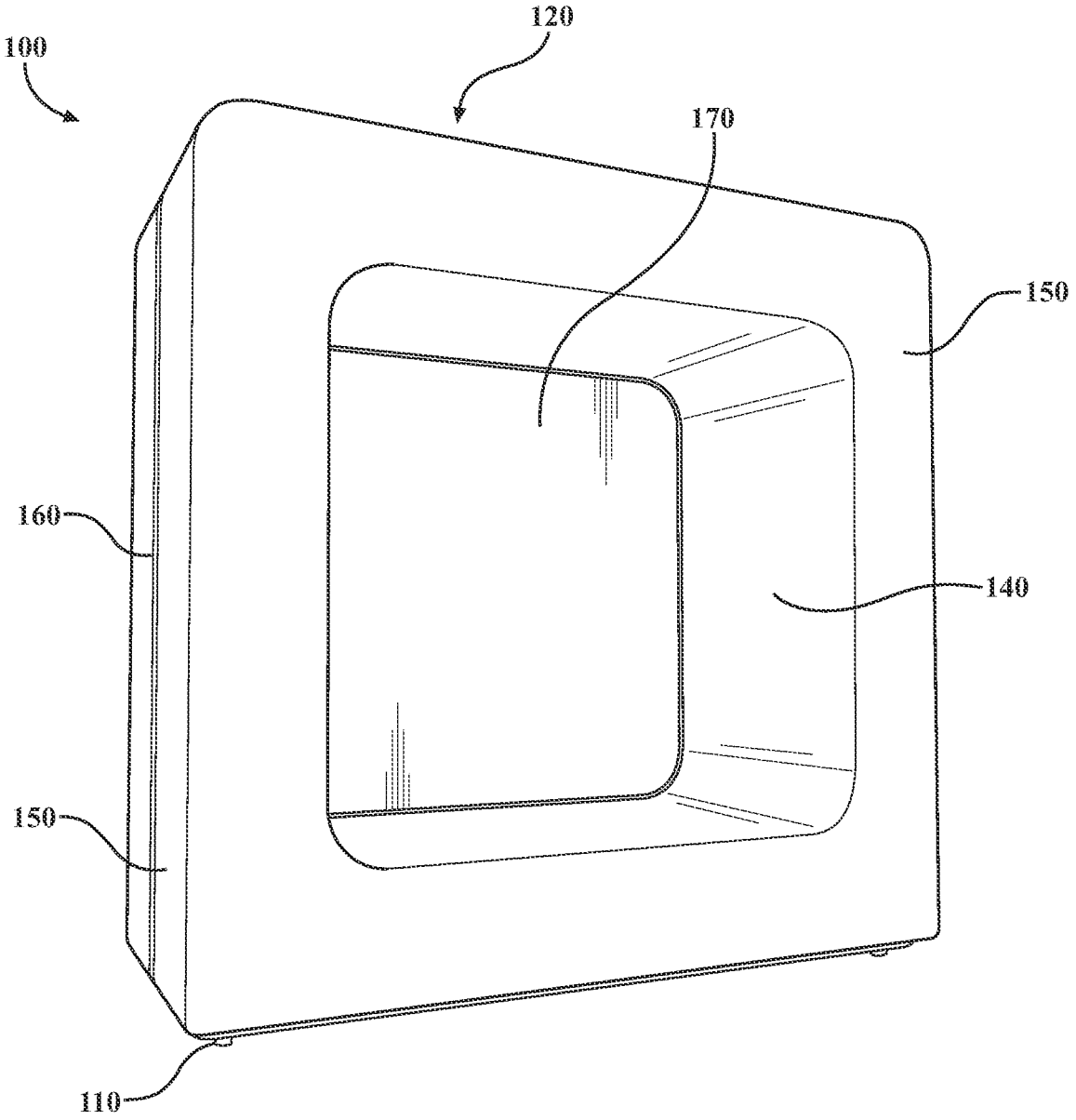
FIG. 2 illustrates the foam-based square seat of FIG. 1 with a removable square nesting insert positioned in the cutout opening.
Figure 3:
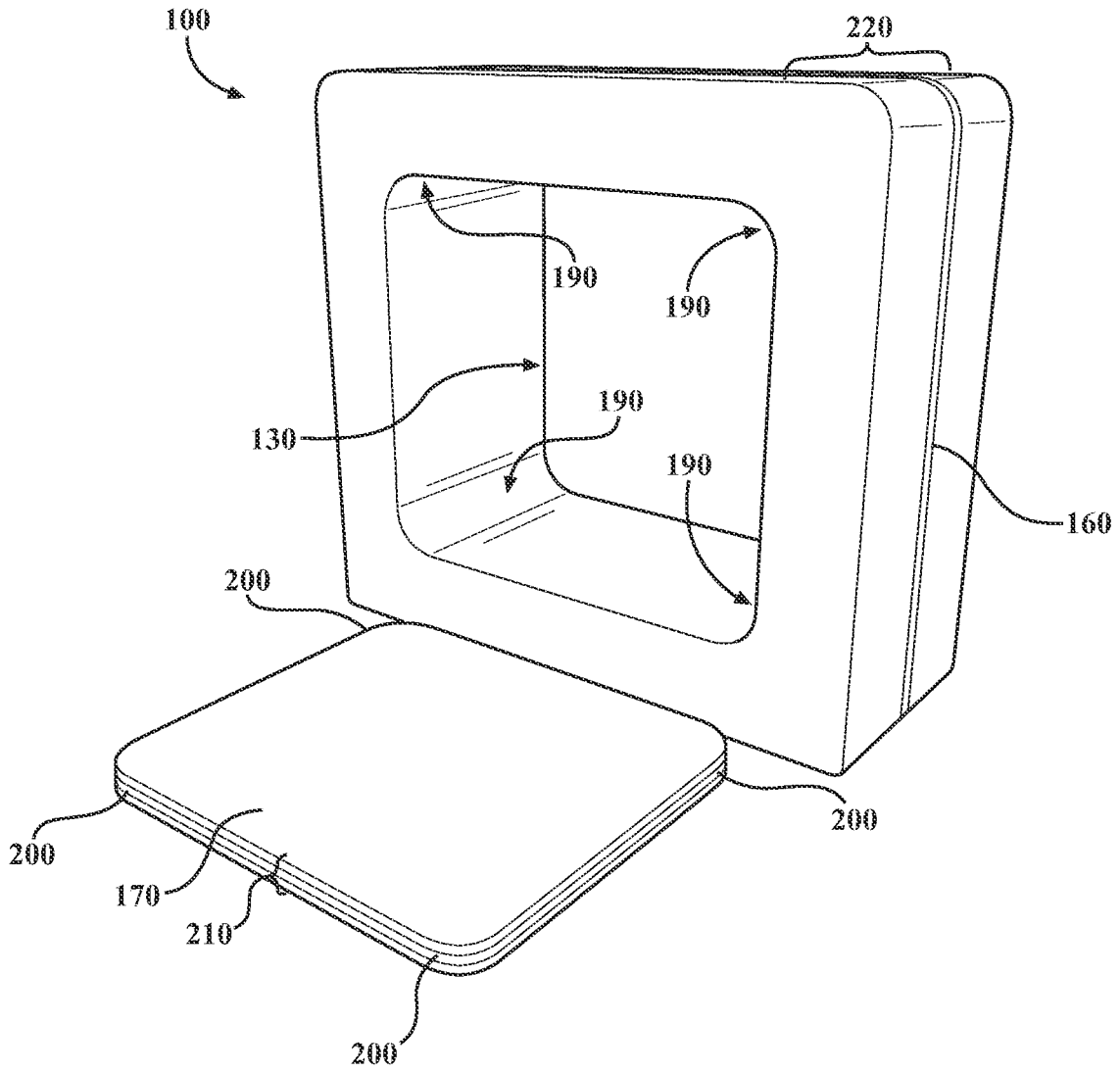
FIG. 3 illustrates the foam-based square seat of FIG. 1 with the removable square nesting insert removed from the opening and resting horizontally to provide additional seating.

Furniture and available seating are important elements in elementary through collegiate classrooms. Classroom seating needs to provide a multitude of students with a comfortable place to study while also being moveable and adjustable to reflect the ever-changing circumstances of the learning environment. Often, furniture in a lounge area of the classroom needs to be moved to create space for another learning activity. Furniture that is derived from foam and that does not include rigid structures can provide a comfortable seating surface that is aesthetically pleasing and that creates a warm and welcoming environment, while also being lightweight and easy to move. Foam furniture can also be easily disassembled to rearrange into different orientations. These attributes make foam-based seating uniquely suited for use in elementary through collegiate level classrooms as they can easily create seating for a multitude of students that provides comfortable support for long hours of studying for a while also being easy to move and reconfigure, durable, and resistant to damage.

Referring to FIGS. 1-15, the present disclosure provides for foam-based seating furniture having a removable insert. In an example, a single removable insert is provided. In another embodiment, a plurality of inserts are provided. The plurality of inserts can all be identical or different in size and shape or mating shapes to fill the cutout opening.

As shown in the examples of FIGS. 1-4, a foam-based seat 100 includes a base 110 which is continuous with a main body 120. The main body 120 includes an outer surface 150 and defines a cutout opening 130 in a center of the main body 120, forming an inner seating surface 140. Together, the main body 120 and base 110 have exterior surfaces. A fitted fabric 155/165 (shown in FIGS. 12 and 13, respectively) is configured to encase the exterior surfaces of a foam of the main body 120 and base 110. The fitted fabric defines a seam 160, which runs along the outer surface 150. A removable nesting insert 170 defines a geometry matching the cutout opening 130, and forms a "nest" configuration with the main body 120; the foam nesting insert 170, which can be can be referred to as the "egg" of the foam-based seat 100, friction fits within the cutout opening 130 against the inner surface 140. The inner seating surface 140 of the cutout opening 130 matches an outer edge of the removable nesting insert 170.

The foam-based seat 100 and removable nesting insert 170 are formed of a foam core which can provide a desired durable and comfortable feel while also remaining lightweight, aesthetically pleasing, and cost effective. In an example, the removable nesting insert 170 is made from a foam material that is cutout when forming cutout opening 130 during manufacturing. The foam material provides for a comfortable seating surface that can be easier to manufacture and mold into different shapes, sizes and contours than traditional furniture made from wood, plastic, composite, or metal. Further, because the chair is made of foam, the chair can be much lighter in weight as compared to traditional furniture. This allows for modularity and customization. Such a lightweight material is particularly useful in a classroom setting as the classroom setup is often rearranged and adapted for particular circumstances. The foam core is enclosed with a fitted fabric that is measured to fit closely around all or most of the exterior surfaces of the foam. The fitted fabric can be made of a desired material that also protects the foam from damage and stains such as leather, microfiber vinyl, or other suitable fabric. A fitted fabric also encases the removable nesting insert 170 and is made of a member of the same group of fabrics as the fitted fabric for the main body 120.

Figure 4:
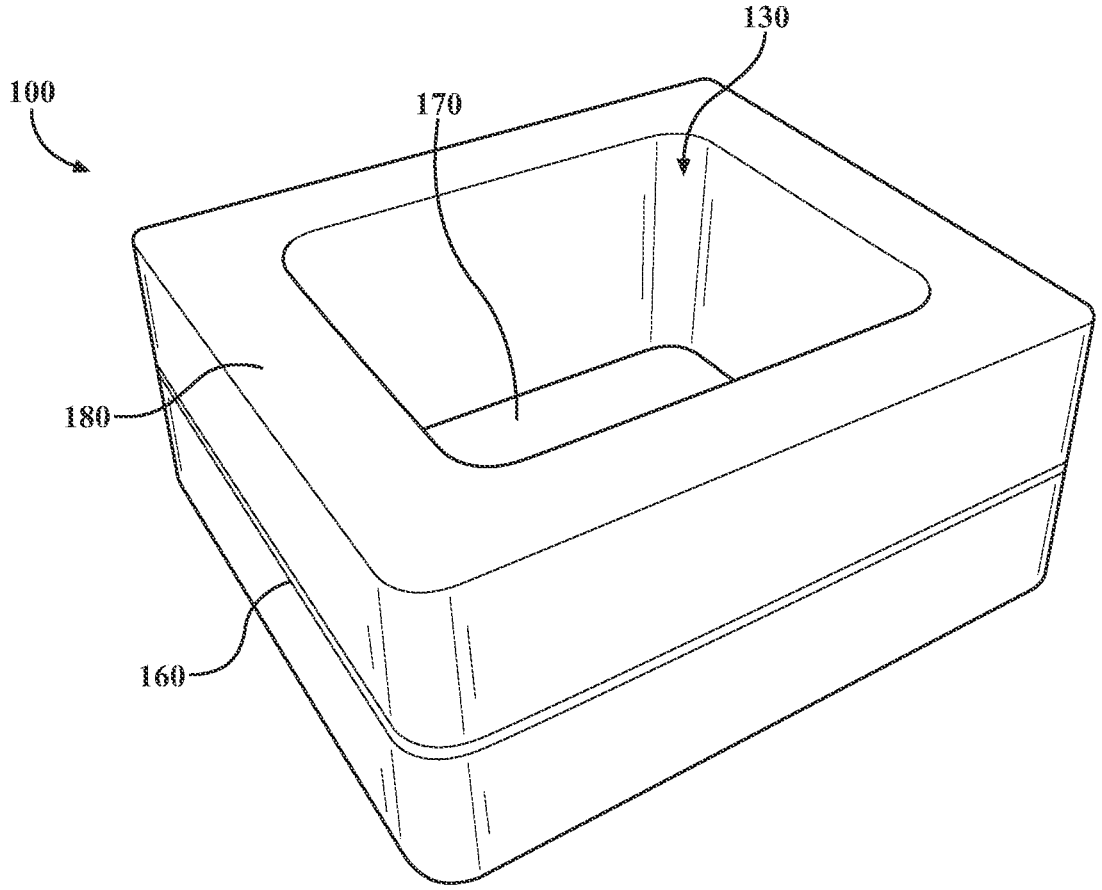
FIG. 4 illustrates a perspective view of the foam-based square seat of FIG. 1. placed in a horizontal or flat orientation and the removable square nesting insert positioned within the opening.
Figure 5:
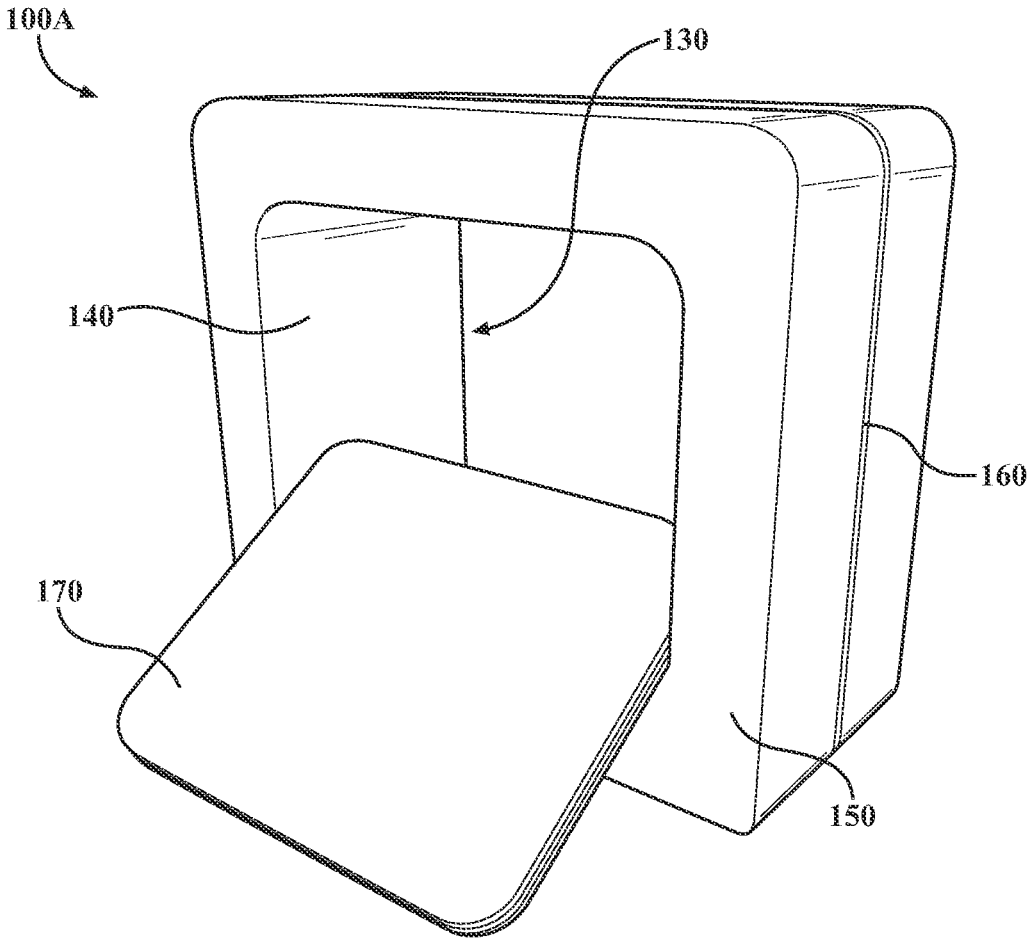
FIG. 5 illustrates a relatively smaller foam-based square chair as compared to FIG. 1 defining a cutout forming an opening and a removable square insert removed from the opening.
Figure 6:
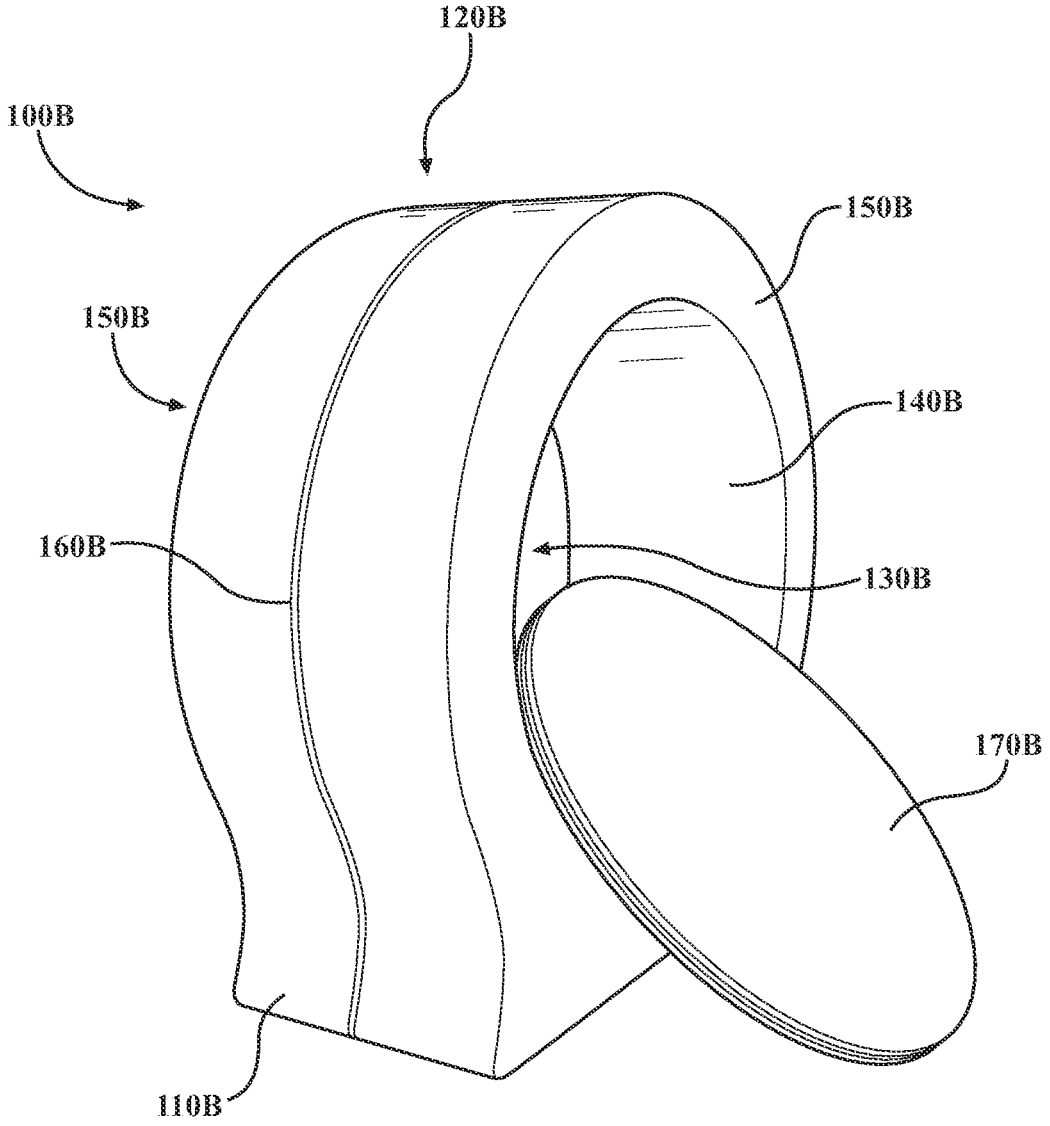
FIG. 6 illustrates a perspective view of a foam-based round seat having a base and defining a center cutout forming a cutout opening and a removable circular nesting insert removed from the cutout opening.
Figure 7:
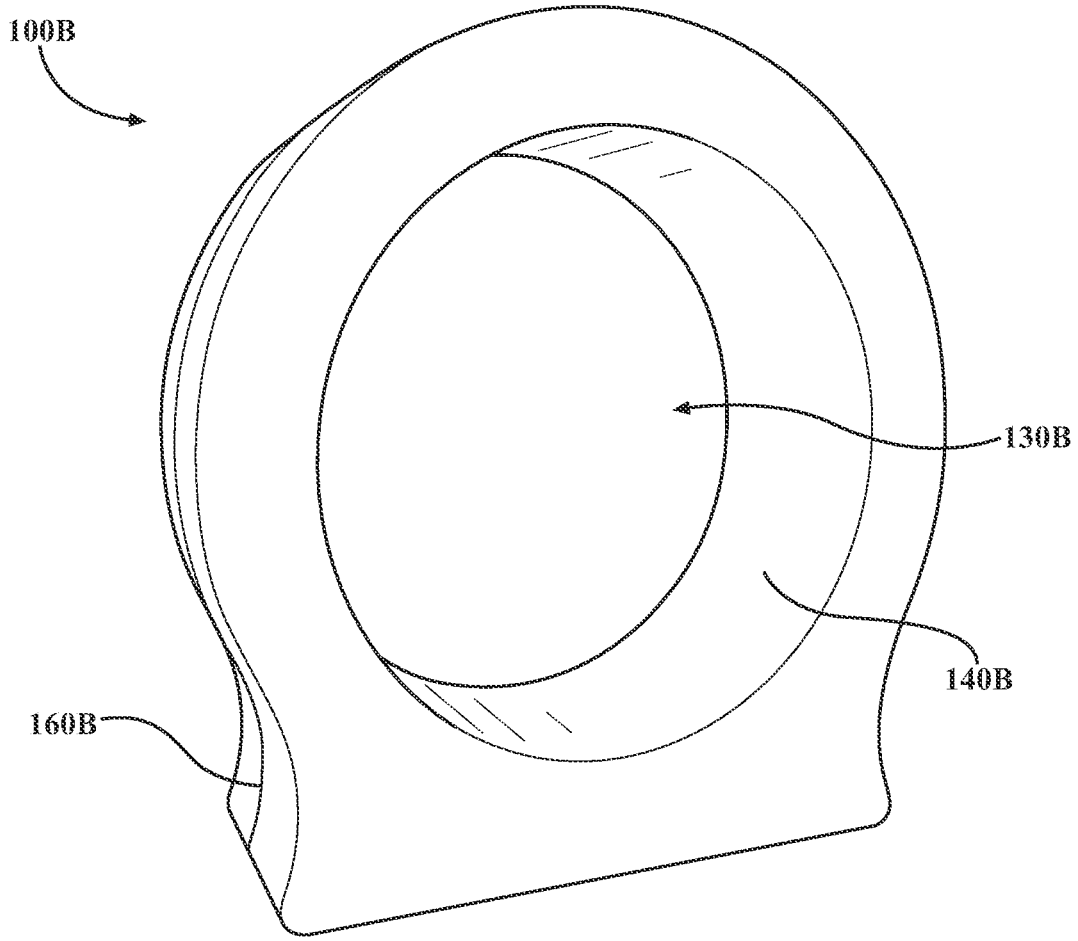
FIG. 7 illustrates the foam-based round seat of FIG. 6 defining a circular cutout opening and absent the circular nesting insert.
Figure 8:
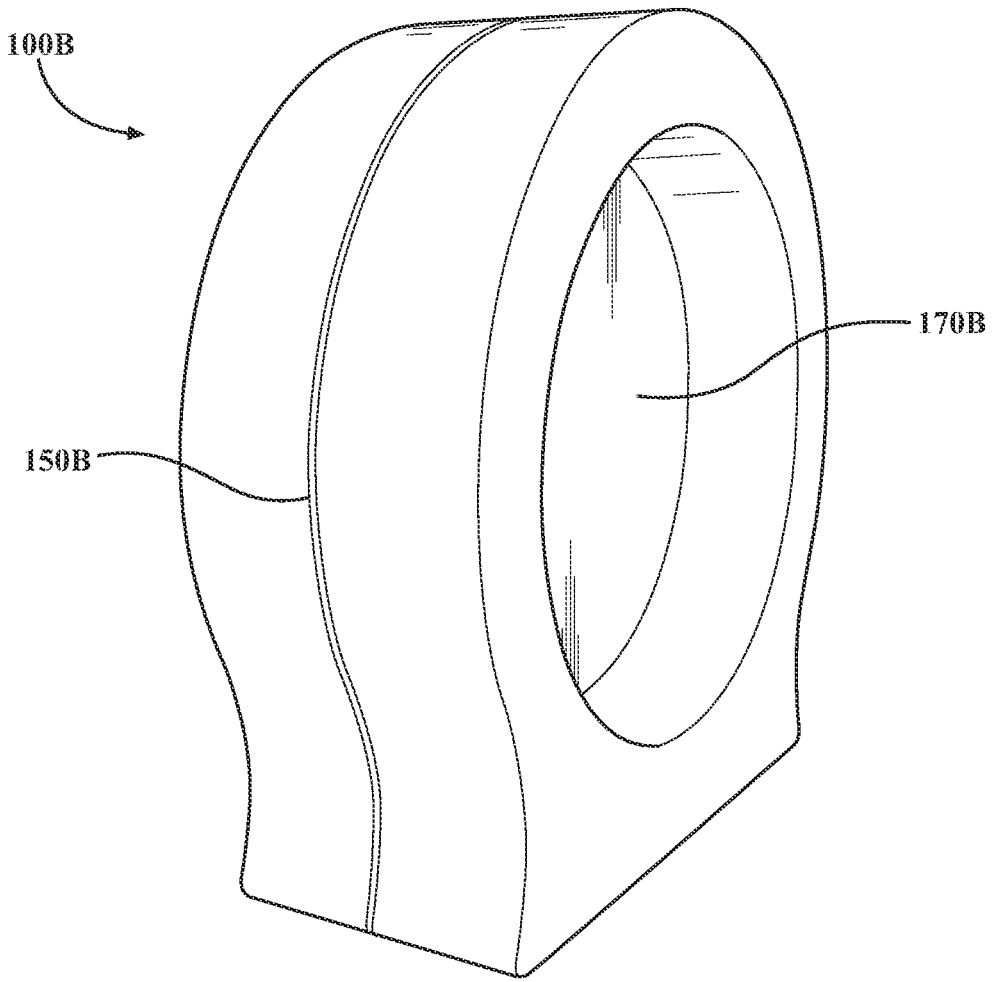
FIG. 8 illustrates a side perspective view the foam-based round seat of FIG. 6 with the removable circular nesting insert positioned within the cutout opening.
Figure 9:
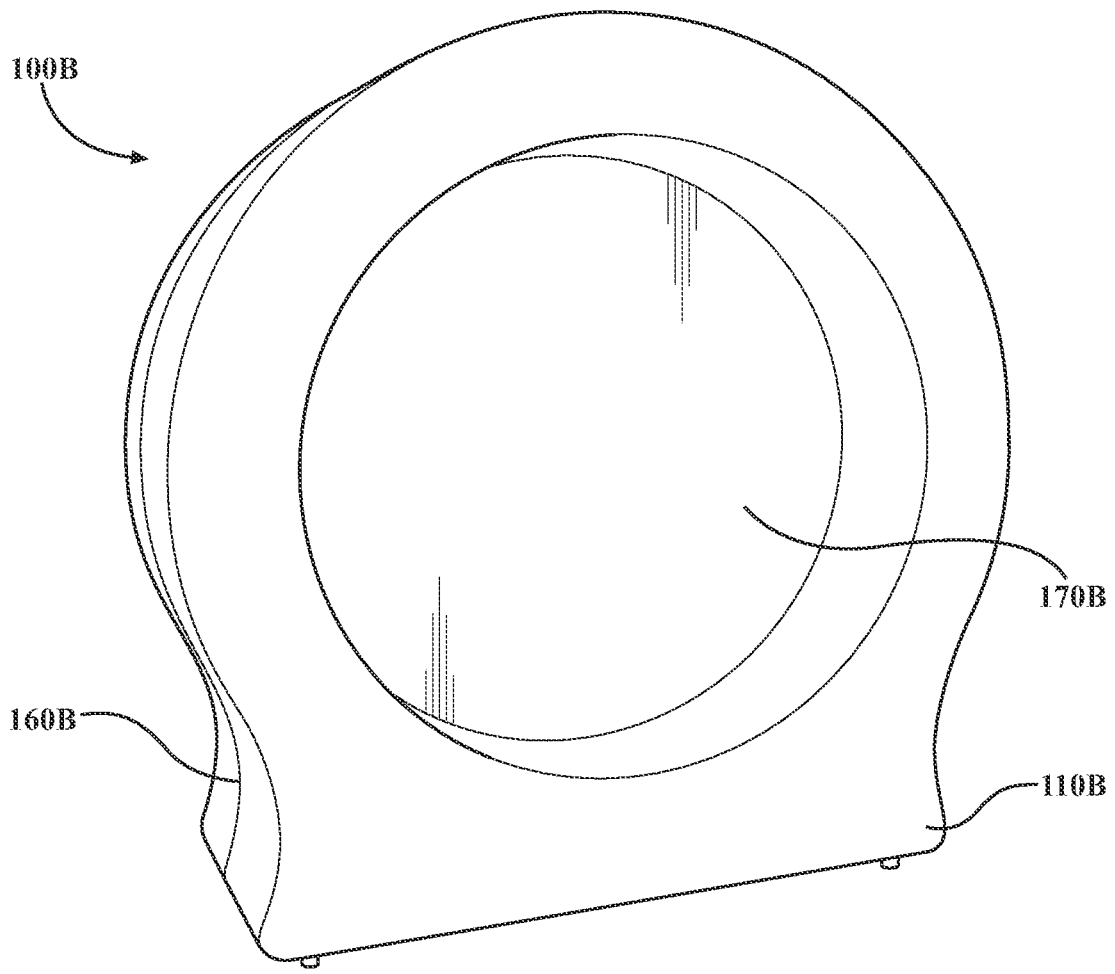
FIG. 9 illustrates a front perspective the foam-based round seat of FIG. 6 with the removable circular nesting insert positioned within the cutout opening.
Figure 10:
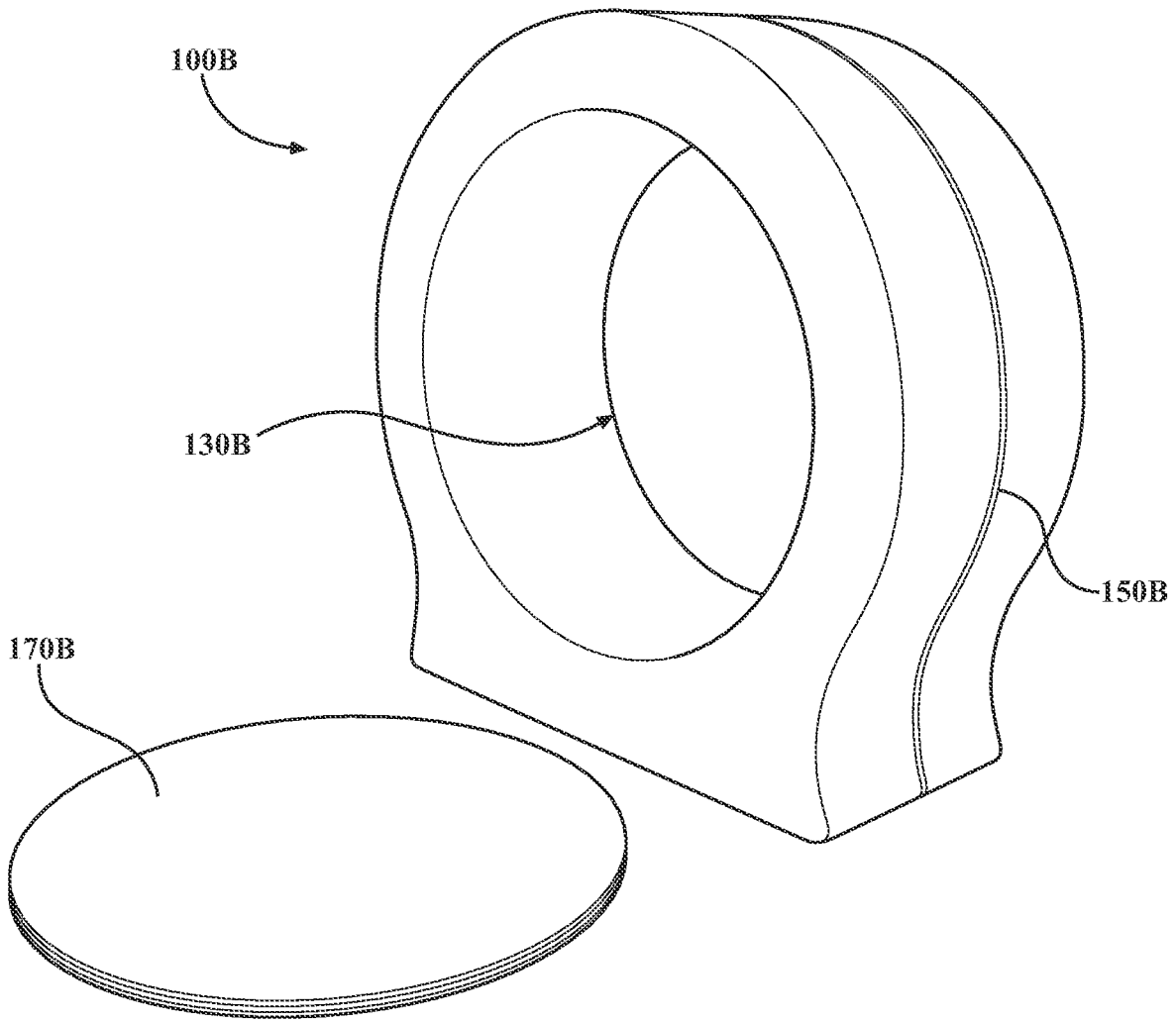
FIG. 10 illustrates the foam-based round seat of FIG. 6 with the removable circular nesting insert removed and resting horizontally to provide additional seating.
Figure 11:
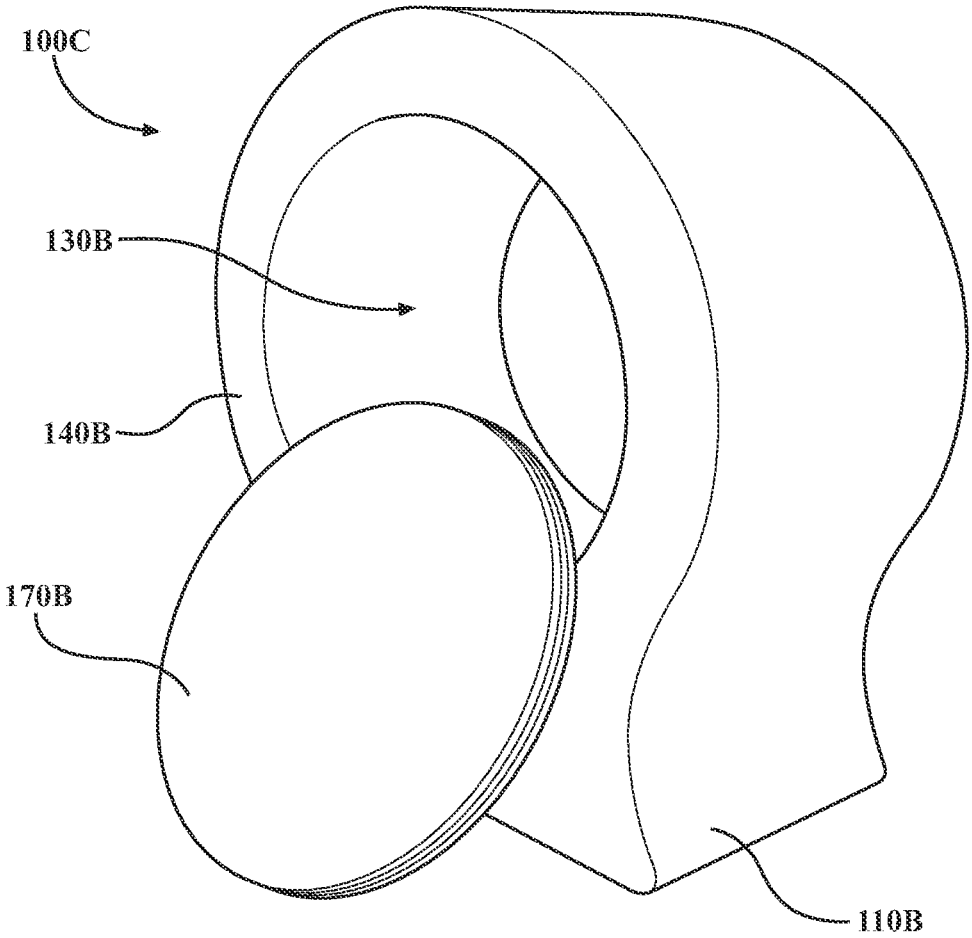
FIG. 11 illustrates a perspective view of a smaller foam-based round seat as compared to FIG. 6 having a base and a removable circular nesting insert removed from a cutout opening.

In the examples of FIGS. 1-5, the foam-based seat 100 defines a square geometry having a square cutout opening 130 in the main body 120. The removable nesting insert 170, also square shaped and made from foam, friction fits within the cutout opening 130 to define a removable wall which can provide sound dampening for users. The removable nesting insert 170 also serves as a standalone seating device when placed horizontally on a floor (FIG. 3), and the main body 120 defines a bench seat 180 when resting in a horizontal configuration FIG. 4, which allows for the presence of insert 170 as a foot rest or floor or it can be removed. The cutout opening 130 is sized and shaped to allow for a user, such as a child or adult, to sit comfortably within it when the foam-based seat 100 is in a vertical configuration (FIGS. 1-3 and 5). FIG. 5 illustrates a variation in size of a seat 100A having like features of seat 100.

Referring to FIGS. 6-11, in another example, the foam-based seat 100B defines a round shape defining a circular cutout in the main body 120B forming the cutout opening 130B. In this example, the base 110B of the round foam-based seat 100B extends down and away from the main body 120B and defines an enlarged expanded base. A planar removable nesting insert 170B, also round shaped and made from foam, friction fits within the cutout opening 130B to define a removable wall which provides sound dampening for users. The removable nesting insert 170B also serves as a standalone seating device when placed horizontally on a floor (FIG. 10), and the main body 120B defines a bench seat 180 when resting in a horizontal configuration. The cutout opening 130B is sized and shaped to allow for a user, such as a child or adult, to sit comfortably within it when the chair is in a vertical configuration (FIGS. 6-11) and the removable nesting insert 170B.

Figure 12:
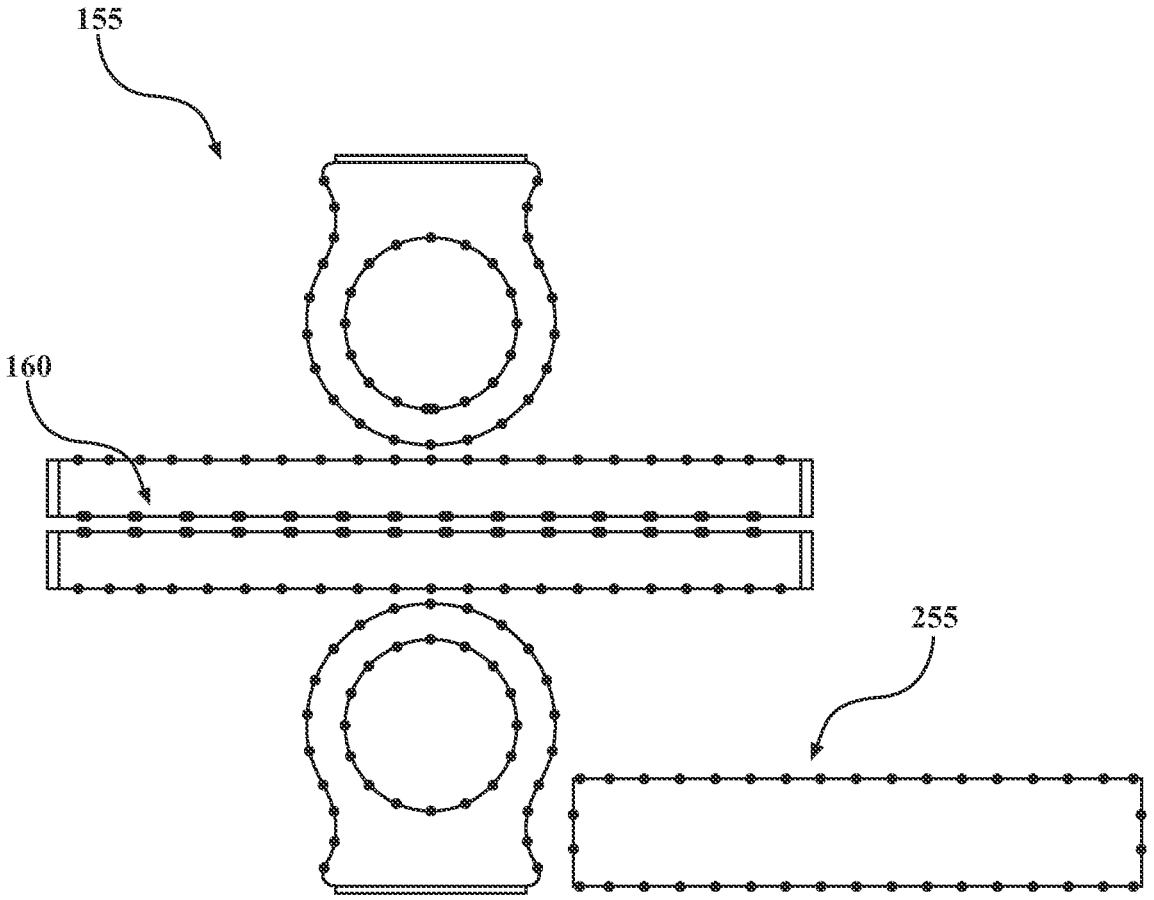
FIG. 12 illustrates a schematic of a fitted fabric design configured to encase a foam-based round seat having a base and defining a cutout forming a cutout opening.
Figure 13:
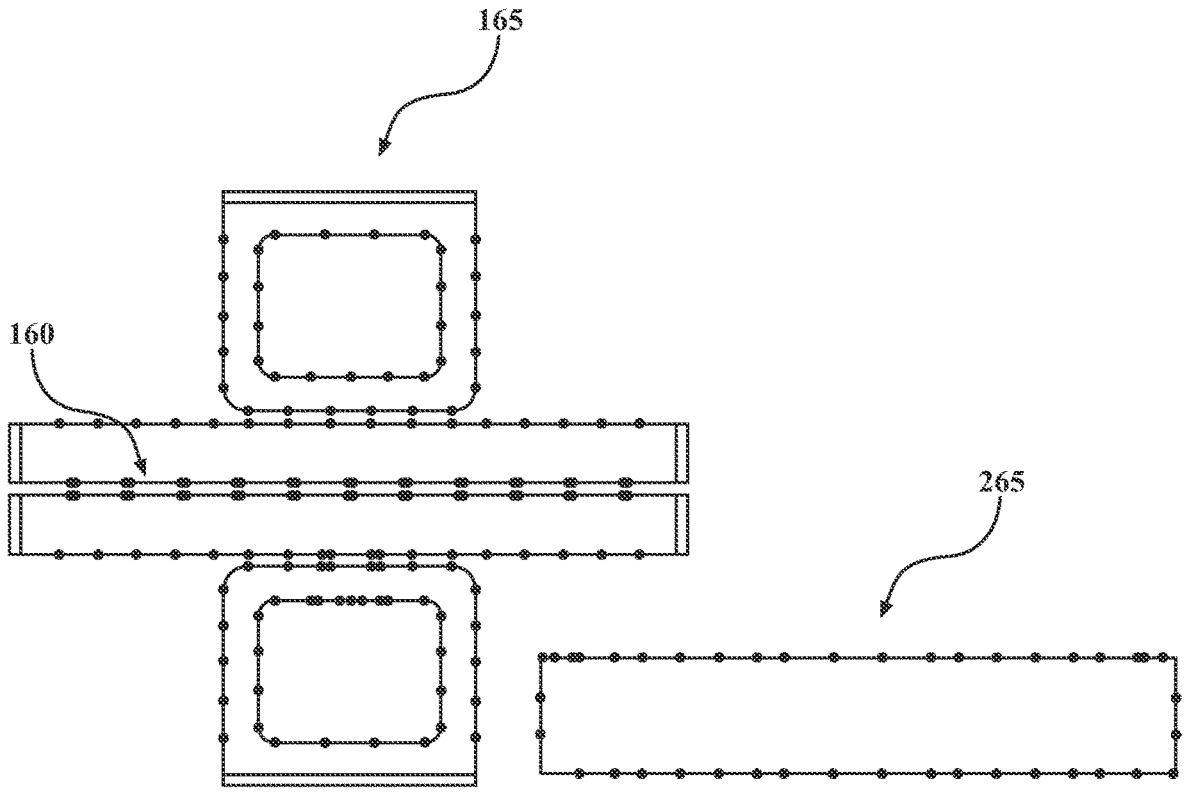
FIG. 13 illustrates a schematic of a fitted fabric design configured to encase a foam-based square seat defining a cutout forming a cutout opening.

Referring to FIGS. 12-13, a fitted fabric 155/165 of the foam-based seat 100 forms a seam 160 along a center of the outer surface 150 of the main body 120 where the fabric connects. The fitted fabric encompasses the foam and is stitched together and connected to fully encapsulate the foam. An insert fitted fabric 255/265 also encases the removable nesting insert, which can create a friction fit wall within the cutout opening. In an example, the fitted fabric 155/165 and insert fitted fabric 255/265 can be made of leather, microfiber, vinyl, cloth, and combination thereof or any desired material while also serving to protect the foam from damage and stains.

The removable nesting insert 170 can be removed from the cutout opening 130, requiring very little force for removal. Removal of the removable nesting insert 170 may be done by applying pressure to the upper or lower portion of the removable nesting insert 170 and loosening the removable nesting inset 170 for easy removal. The removable nesting insert 170 is removable without the use of tools or assistance aids to create an opening so that the user can access inner seating surface 140 as he/she pleases.

Removal of the removable nesting insert creates an open configuration. This open configuration allows a user to access the cutout opening in a variety of ways including sitting or lying down on the inner seating surface 140 along a circumference of the cutout opening 130. The foam-based seat 100 can be orientated in a standing/vertical or flat/horizontal configuration. When the foam-based seat 100 is positioned in a flat/horizontal configuration, it provides a bench seat 180 upon which multiple users can congregate while placing their legs and feet within the cutout opening 130.

The removable nesting insert 170 can be positioned in an upright/vertical configuration within the cutout opening 130, creating a friction fit with the insert fitted fabric of the removable nesting insert 170 against the fitted fabric on the inner seating surface 140. This is referred to as a nest/egg relationship. The removable nesting insert 170, when inserted, forms a friction fit wall inside the cutout opening 130. This defines a perimeter at the junction of the removable nesting insert 170 and the inner seating surface 140 of the main body 120.

In one example, removable nesting insert 170 defines a relatively thin, almost disc-like insert thickness 210. The insert thickness 210 of the removable nesting insert 170 is relatively smaller than that of a main body thickness 220 of the foam-based seat 100. The difference in the insert thickness 210 and the main body thickness 220 forms a seating ledge extending from a perimeter of the friction fit wall to an outer edge of the inner seating surface 140. In an example, the removable nesting insert 170 can be positioned anywhere along the inner seating surface 140 to provide a variety of seating depths. This configuration of the seating ledge and the friction fit wall defines a settee, wherein the seating ledge constitutes a seat of the settee, and the fiction fit wall constitutes a soft back.

In yet another example, the foam-based seat 100 can be positioned vertically on a base 110 configured with a baseboard and/or standing legs. When vertical, the cutout opening 130 faces parallel to the ground so that users can sit within the cutout opening 130 on the inner seating surface 140. As shown in FIG. 4, foam-based seat 100 can also be orientated horizontally so that cutout opening 130 is facing perpendicular to the ground. Users can then step within the cutout opening 130 and sit along on the bench seat 180 of the outer surface 150. The different configurations and uses of foam-based seat 100 are useful for a learning student that spends hours studying or reading. Moreover, in a horizontal orientation, foam-based seat 100 allows for congregating of multiple users. With the different configurations of foam-based seat 100, the student can alter the seating position to get more comfortable in their studies and even create more seating for other students when needed. In an example, the removable nesting insert 170 is positioned within the cutout opening 130 and serves as a removable floor in a horizontal orientation.

Referring to FIGS. 1-5, example foam-based square seats 100 and 100A are provided defining a cutout opening 130 and having a removable nesting insert 170. Foam-based square seat 100 is shown wherein a square cutout opening 130 is formed in the center of a main body 120 and is defined by an inner seating surface 140. In an example, main body 120 and inner seating surface 140 define a relatively square geometry having rounded inner surface corners 190. This can be done to assist with assembly, for aesthetic purposes, and/or to provide for more comfortable seating. In such an embodiment, the removable nesting insert 170 defines outer surface corners 200, which are also rounded to fit within the cutout opening 130. Foam-based square seat 100 can be made in a variety of sizes as shown in comparison of the larger example of FIGS. 1-4 and the smaller version shown in FIG. 5. FIG. 5 illustrates a smaller version of a foam-based square seat 100A having similar parts labeled with similar number identifiers.

Referring to FIGS. 6-11, example foam-based round seats 100B and 100C are provided defining a circular cutout opening 130B and having a circular removable nesting insert 170B. Foam-based round seat 100B is shown with cutout opening 130B defined by an inner seating surface 140B. In this example, seam 160B runs down a center of an outer surface 150B wherein a fitted fabric encompasses the foam and is stitched together and connected to fully encapsulate the foam. A circular removable nesting insert 170B is provided and is also made of a foam and encapsulated in an insert fitted fabric. When in place, the user can remove the removable nesting insert 170B by applying pressure to the removable nesting insert 170B, loosening the removable nesting insert 170B from a friction fit with the inner seating surface 140B. The removable nesting insert 170B can then be removed from cutout opening 130B to create an opening so that the user can access the inner seating surface 140B, for example to lie down or sit within an inner perimeter of circular cutout opening 130B. Chair 200 can be made at differing sizes (see chair 100C) so that more or less individuals can comfortably sit within the cutout opening 130B.

In an example, seat 100B is orientated vertically on base 110B which extends down and away from the main body 120B. The base 110B may be made of baseboard and legs, defining a wide base with a thickness equal to a thickness of the foam-based seat 100B. In this example, base 110B is formed integral with the shape of foam-based seat 100B from an identical foam mold. In a vertical orientation, the circular cutout opening 130B is configured to stand to allow users to sit within inner seating surface 140B. In a further example, the cutout opening 130B can be angled slightly upwards. A benefit of using foam is the ease in adjusting desired geometries and configurations. In yet a further example, the foam-based round seat 100B is positioned horizontally on outer surface 150B so that the cutout opening 130B is facing perpendicular to the ground. Users can then step within cutout opening 130B and sit on the bench seat 180 of the outer surface 150A.

Figure 14:
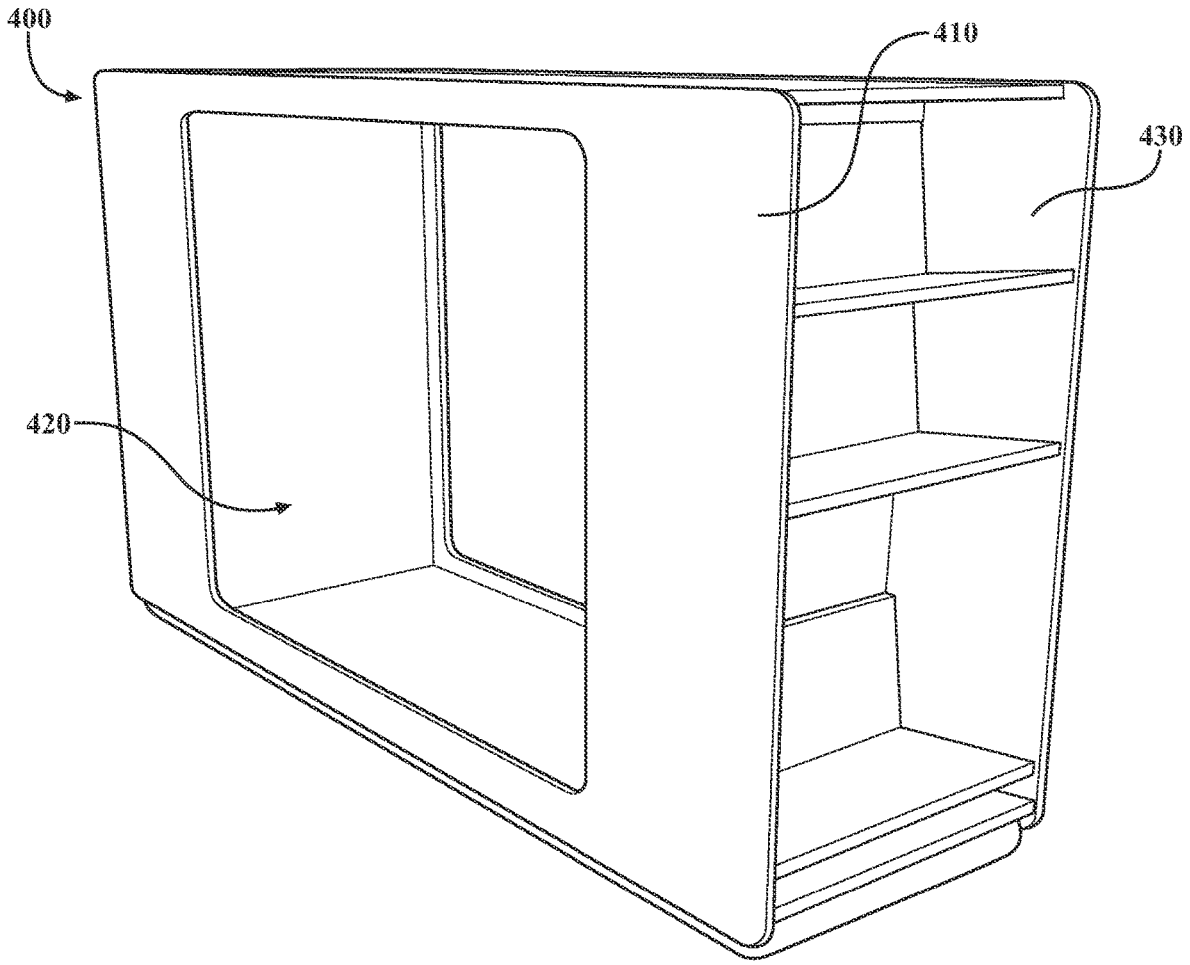
FIG. 14 illustrates a perspective view of an enclosure for a foam-based seat.
Figure 15:
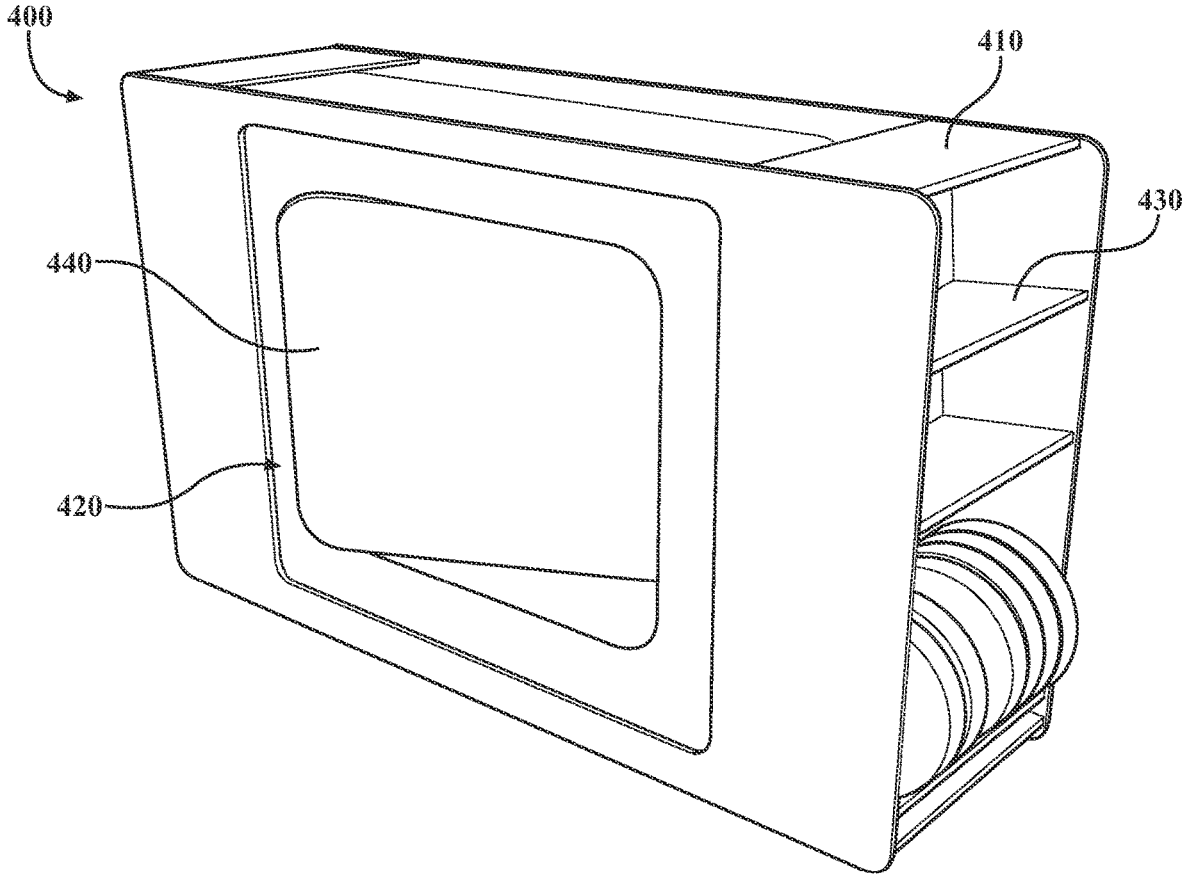
FIG. 15 illustrates a perspective view of the enclosure for a foam-based seat of FIG. 14 with a foam-based seat in positioned in an internal opening.

Referring to FIGS. 12-13, a schematic drawing of the fitted fabric 155/165 configured to encase the foam-based square (FIG. 13) or round seat (FIG. 12). The foam material in the seat is covered with a fitted fabric that encases the foam-based core and holds it in place. The fabric can be configured and measured to fit exactly around all exterior portions of the chair, and the fabric can be made of a desired comfortable material that also protects the foam-based core from damage and stains. The fabric is stitched together at the seams along the outer surface of the chair allowing for an annular design for a fully enclosed perimeter In another example, the present disclosure also provides for an enclosure for a foam-based seat 400 as shown in FIGS. 14-15. The enclosure 400 defines a rigid frame 410 defining an internal opening 420. The rigid frame 410 can be made from any lightweight and sturdy material such as wood, vinyl, plastic, medium density fiberboard, composite, particle board, metal, or combinations thereof. The internal opening 420 is configured to circumscribe a foam-based seat 440. In this example, the rigid frame 410 includes shelving units 430 positioned on outer ends.

In an embodiment, the enclosure for a foam-based seat 400 is rectangular and is configured to circumscribe a square foam-based seat 440, wherein the foam-based seat has a cutout opening in which a removable nesting insert friction fits. A user may sit or lie within the foam-based seat 440 supported within the internal opening 420. The shelving units 430 may function to hold the removable nesting inserts when they are removed from the foam-based seat, or to hold extra removable nesting inserts and other classroom materials. The enclosure for the foam-based seat 400 may also function as a dividing wall in a classroom setting.

The embodiments of the disclosure described herein are exemplary, and numerous modifications, variations and rearrangements can be readily envisioned to achieve substantially equivalent results, all of which are intended to be embraced within the spirit and scope of the disclosure. Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application.

What is claimed is:

1. A seating furniture comprising:

a) a base;

b) a foam main body extending from the base;

c) a cutout opening formed in the main body defining an inner seating surface and an outer surface;

d) a fitted fabric configured to encase the main body, having a seam that runs along the outer surface; and e) a removable nesting insert configured to friction fit within the inner surface of the cutout opening of the main body;

wherein the removable nesting insert is configured to provide seating when separated from the main body, wherein the main body defines a bench seat in a horizontal configuration, wherein the removable nesting insert defines an insert thickness, the main body defines a body thickness, and the insert thickness is less than the body thickness.

2. The seating furniture according to claim 1, wherein the main body defines a square, and the removable nesting insert is square.

3. The seating furniture according to claim 2, wherein the inner surface of the cutout opening defines inner surface corners, the removable nesting insert defines outer surface corners, and the inner surface corners of the cutout opening and outer surface corners of the removable nesting insert are rounded.

4. The seating furniture according to claim 1, wherein the main body defines a circular geometry and the removable nesting insert is circular.

5. The seating furniture according to claim 1, wherein the main body is circular, and the base extends down and away from the main body to define an expanded base.

6. The seating furniture according to claim 5, wherein the removable nesting insert is circular.

7. The seating furniture according to claim 1, wherein the main body defines exterior surfaces encompassing the base, and main body.

8. The seating furniture according to claim 7, wherein the fitted fabric defines a single continuous fabric that fits around the exterior surface of the main body and base.

9. The seating furniture according to claim 8, wherein an insert fitted fabric encases the removable nesting insert.

10. The seating furniture according to claim 9, wherein the fitted fabric and the insert fitted fabric are made of a member selected from the group containing leather, microfiber, vinyl, cloth, and combinations thereof.

11. The seating furniture according to claim 1, wherein the main body and the removable nesting insert when combined create a removable wall and wherein the removable wall is sound dampening.

12. The seating furniture according to claim 1, wherein the bench seat is configured to allow multiple users to sit on the bench seat while placing their legs and feet within the cutout opening.

13. The seating furniture according to claim 1, wherein the cutout opening in the main body is sized and shaped to allow for a user to sit or recline comfortably within the cutout opening when the main body is in a vertical configuration and the removable nesting insert is removed.

14. The seating furniture according to claim 1, wherein the removable nesting insert, when inserted, forms a friction fit wall inside the cutout opening, which defines a perimeter.

15. The seating furniture according to claim 14 wherein the difference in the insert thickness and the main body thickness forms a seating ledge extending from the perimeter of the friction fit wall to an outer edge defined by the main body.

16. The seating furniture according to claim 15, wherein the seating ledge and the friction fit wall creates a settee, wherein the ledge constitutes a seat of the settee, and the fiction fit wall constitutes a soft back.

17. The seating furniture according to claim 1, further comprising a plurality of removable nesting inserts.

18. An enclosure for a seating furniture comprising:

(a) a rigid frame, wherein the rigid frame includes two opposite ends;

(b) an internal opening configured to circumscribe a foam-based seat having a removable insert positioned within a cutout of a main body of the foam-based seat; and (c) shelving units, wherein the shelving units are positioned at and extend from the two ends of the rigid frame, and wherein the removable insert defines an insert thickness, the main body of the foam-based-seat defines a body thickness, and the insert thickness is less than the body thickness.

19. The enclosure of claim 18, wherein the rigid frame is made from a member selected from the group containing wood, vinyl, plastic, medium density fiberboard, particle board, metal, and combinations thereof.

* * * * *